US007462003B2

(12) United States Patent
Middlemiss

(10) Patent No.: US 7,462,003 B2
(45) Date of Patent: Dec. 9, 2008

(54) POLYCRYSTALLINE DIAMOND COMPOSITE CONSTRUCTIONS COMPRISING THERMALLY STABLE DIAMOND VOLUME

(75) Inventor: Stewart N. Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 168 days.

(21) Appl. No.: 11/197,120

(22) Filed: Aug. 3, 2005

(65) Prior Publication Data

US 2007/0029114 A1 Feb. 8, 2007

(51) Int. Cl.
*B32B 9/00* (2006.01)

(52) U.S. Cl. ..... 407/119; 428/212; 428/336; 428/408; 428/469

(58) Field of Classification Search ..... 428/212, 428/336, 408, 469; 407/119
See application file for complete search history.

(56) References Cited

U.S. PATENT DOCUMENTS 5,011,514 A * 4/1991 Cho et al. ..... 51/295
5,560,716 A * 10/1996 Tank et al. ..... 428/408
5,645,617 A * 7/1997 Frushour ..... 51/309
6,063,333 A * 5/2000 Dennis ..... 419/6
6,344,149 B1 * 2/2002 Oles ..... 216/11
6,544,308 B2 * 4/2003 Griffin et al. ..... 428/408
6,592,985 B2 * 7/2003 Griffin et al. ..... 428/212

FOREIGN PATENT DOCUMENTS

EP 1 190 791 * 3/2002
RU 2 034 937 * 5/1995

* cited by examiner

*Primary Examiner*—Archene Turner
(74) *Attorney, Agent, or Firm*—Connolly Bove Lodge & Hutz LLP

(57) ABSTRACT

PCD composite constructions comprise a diamond body bonded to a substrate. The diamond body comprises a thermally stable diamond bonded region that is made up of a single phase of diamond crystals bonded together. The diamond body includes a PCD region bonded to the thermally stable region and that comprises bonded together diamond crystals and interstitial regions interposed between the diamond crystals. The PCD composite is prepared by combining a first volume of PCD with a second volume of diamond crystal-containing material consisting essentially of a single phase of bonded together diamond crystals. A substrate is positioned adjacent to or joined to the first volume. The first and second volumes are subjected to high pressure/high temperature process conditions, during process the first and second volumes form a diamond bonded body that is attached to the substrate, and the second volume forms the thermally stable diamond bonded region.

24 Claims, 5 Drawing Sheets

POLYCRYSTALLINE DIAMOND COMPOSITE CONSTRUCTIONS COMPRISING THERMALLY STABLE DIAMOND VOLUME

FIELD OF THE INVENTION

This invention generally relates to diamond bonded composite materials and, more specifically, diamond bonded composite materials and compacts formed therefrom that are specially designed to provide improved thermal stability when compared to conventional polycrystalline diamond.

BACKGROUND OF THE INVENTION

Polycrystalline diamond (PCD) materials and PCD elements formed therefrom are well known in the art. Conventional PCD is formed by combining diamond grains with a suitable solvent catalyst material to form a mixture. The mixture is subjected to processing conditions of extremely high pressure/high temperature, where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials typically used for forming conventional PCD include solvent metals from Group VIII of the Periodic table, with cobalt (Co) being the most common. Conventional PCD can comprise from 85 to 95% by volume diamond and a remaining amount of the solvent metal catalyst material. The solvent catalyst material is present in the microstructure of the PCD material within interstices that exist between the bonded together diamond grains.

A problem known to exist with such conventional PCD materials is thermal degradation due to differential thermal expansion characteristics between the interstitial solvent catalyst material and the intercrystalline bonded diamond. Such differential thermal expansion is known to occur at temperatures of about 400° C., causing ruptures to occur in the diamond-to-diamond bonding, and resulting in the formation of cracks and chips in the PCD structure.

Another problem known to exist with conventional PCD materials is also related to the presence of the solvent catalyst material in the interstitial regions and the adherence of the solvent catalyst to the diamond crystals, and is known to cause another form of thermal degradation. Specifically, the solvent catalyst material causes an undesired catalyzed phase transformation to occur in diamond (converting it to carbon monoxide, carbon dioxide, or graphite) with increasing temperature, thereby limiting practical use of such conventional PCD material to about 750° C.

Attempts at addressing such unwanted forms of thermal degradation in PCD are known in the art. Generally, these attempts have involved modifying the PCD body in such a manner as to provide an improved degree of thermal stability at the wear or cutting surface of the body when compared to the conventional PCD material discussed above. One known attempt at producing a thermally stable PCD body involves at least a two-stage process of first forming a conventional sintered PCD body, by combining diamond grains and a cobalt solvent catalyst material and subjecting the same to high pressure/high temperature process, and then removing the solvent catalyst material therefrom.

This method, which is fairly time consuming, produces a resulting PCD body that is substantially free of the solvent catalyst material, and is therefore promoted as providing a PCD body having improved thermal stability. However, the resulting thermally stable PCD body typically does not include a metallic substrate attached thereto by solvent catalyst infiltration from such substrate due to the solvent catalyst removal process. The thermally stable PCD body also has a coefficient of thermal expansion that is sufficiently different from that of conventional substrate materials (such as WC—Co and the like) that are typically infiltrated or otherwise attached to the PCD body to provide a PCD compact that adapts the PCD body for use in many desirable applications. This difference in thermal expansion between the thermally stable PCD body and the substrate, and the poor wetability of the thermally stable PCD body diamond surface makes it very difficult to bond the thermally stable PCD body to conventionally used substrates, thereby requiring that the PCD body itself be attached or mounted directly to a device for use.

However, since such conventional thermally stable PCD body is devoid of a metallic substrate, it cannot (e.g., when configured for use as a drill bit cutter) be attached to a drill bit by conventional brazing process. The use of such thermally stable PCD body in this particular application necessitates that the PCD body itself be mounted to the drill bit by mechanical or interference fit during manufacturing of the drill bit, which is labor intensive, time consuming, and which does not provide a most secure method of attachment.

Additionally, because such conventional thermally stable PCD body no longer includes the solvent catalyst material, it is known to be relatively brittle and have poor impact strength, thereby limiting its use to less extreme or severe applications and making such thermally stable PCD bodies generally unsuited for use in aggressive applications such as subterranean drilling and the like.

Another approach has been to form a diamond body onto the metallic substrate by the process of chemical or plasma vapor deposition (CVD or PVD). Deposition of diamond by CVD or PVD process is one that results in the formation of an intercrystalline diamond bonded structure on the substrate that is substantially free of any solvent metal catalyst. A first problem, however, with this approach is the relatively long amount of time associated with developing a diamond body on the substrate that has a having meaningful diamond body thickness. Another problem with this approach is that the diamond body that is formed from CVD or PVD technique is one that is known to be relatively brittle, when compared to conventional PCD, and thus is susceptible to cracking when placed into a cutting or wear application. A still further problem with this approach is that the diamond body formed by CVD or PVD technique is one that has a relatively weak interface with the metallic substrate, and thus one that is susceptible to separating from the substrate when placed into a cutting or wear application.

It is, therefore, desired that a diamond material be developed that has improved thermal stability when compared to conventional PCD materials. It is also desired that a diamond compact be developed that includes a thermally stable diamond material bonded to a suitable substrate to facilitate attachment of the compact to an application device by conventional method such as welding or brazing and the like. It is further desired that such thermally stable diamond material and compact formed therefrom display properties of hardness/toughness and impact strength that are comparable to conventional thermally stable PCD material described above, and PCD compacts formed therefrom. It is further desired that such a product can be manufactured at reasonable cost without requiring excessive manufacturing times and without the use of exotic materials or techniques.

SUMMARY OF THE INVENTION

PCD composite constructions of this invention are generally provided in the form of a compact comprising a diamond bonded body that is bonded to a substrate. The diamond bonded body comprises a thermally stable region that extends a distance below a diamond bonded body surface. The thermally stable region has a material microstructure consisting essentially of a single phase of diamond crystals that are bonded together. In a preferred embodiment, the thermally stable region has a diamond volume content of approximately 100 percent. The diamond bonded body includes a PCD region that extends from the thermally stable region and is bonded to the thermally stable region. The PCD region comprises bonded together diamond crystals, interstitial regions interposed between the diamond crystals, and a solvent catalyst material. In a preferred embodiment, the PCD region has a diamond volume content of approximately 95 percent, and in some instances in the range of from about 75 percent to about 99 percent.

The PCD composite constructions in the form of compacts are prepared by combining a first volume of diamond crystal-containing material, comprising bonded together diamond crystals and interstitial regions interposed between the diamond crystals, wherein a metal solvent catalyst material is disposed within the interstitial regions, with a second volume of diamond crystal-containing material consisting essentially of a single phase of bonded together diamond crystals. The first volume of diamond crystal-containing material is in contact with a substrate, and wherein the first volume of diamond-containing material, the second volume of diamond-containing material, and the substrate comprise an assembly. The assembly is then subjected to high pressure/high temperature conditions to form a diamond bonded body attached to the substrate. The diamond body comprises a PCD region formed from the first diamond crystal-containing material, and a thermally stable diamond bonded region that is formed from the second diamond-containing material. The PCD region and the thermally stable diamond bonded region are integrally joined together, and the thermally stable diamond bonded region is positioned along a working surface of the compact.

PCD composite constructions and compacts of this invention can be used as cutting elements on drill bits used for drilling subterranean formations. PCD composite constructions of this invention formed according to the principles of this invention have improved thermal stability when compared to conventional PCD materials, and include a substrate for purposes of facilitating attachment of the diamond bonded compact to an application device by conventional methods such as welding or brazing and the like. Further, PCD composite constructions and compacts of this invention display properties of hardness/toughness and impact strength that are comparable to conventional thermally stable PCD materials described above, and PCD compacts formed therefrom.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

PCD composite materials comprising thermally stable diamond volumes and compacts of this invention are specifically engineered having a diamond body that is a composite construction comprising a PCD region and a thermally stable diamond bonded region, thereby providing a diamond body having an improved degree of thermal stability when compared to conventional PCD materials. Additionally, PCD composite materials of this invention can be provided in the form of a compact that comprises the above-noted diamond body joined to a substrate.

As used herein, the term "PCD" is used to refer to polycrystalline diamond that has been formed at high pressure/high temperature (HPHT) conditions through the use of a metal solvent catalyst. Suitable metal solvent catalysts include, but are not limited to, those metals included in Group VIII of the Periodic table. The thermally stable diamond bonded region or volume in diamond bonded bodies of this invention, is not referred to as PCD because, unlike conventional PCD and thermally stable PCD that is formed by removing the solvent metal catalyst from PCD, it is fabricated by a different process.

As noted above, PCD composite materials of this invention include a region or volume that comprises conventional PCD, i.e., intercrystalline bonded diamond formed using a metal solvent catalyst, thereby providing properties of hardness/toughness and impact strength that are superior to conventional thermally stable PCD materials that have been rendered thermally stable by having substantially all of the solvent catalyst material removed. Such PCD region also enables the diamond body of PCD composite materials of this invention to be permanently attached to a substrate by virtue of the presence of such metal solvent catalyst. This feature enables PCD composite materials of this invention to be used in the form of wear and/or cutting elements that can be attached to wear and/or cutting, such as subterranean drill bits, by conventional attachment means such as by brazing and the like.

PCD composite materials of this invention are formed using one or more HPHT processes. In an example embodiment, a first HPHT process is used to form the PCD region of the diamond body and attach the body to a desired substrate, and a second HPHT process may be used to consolidate a thermally stable diamond region, volume or body and attach the same to the PCD region, thereby forming the PCD composite material.

Figure 1A:
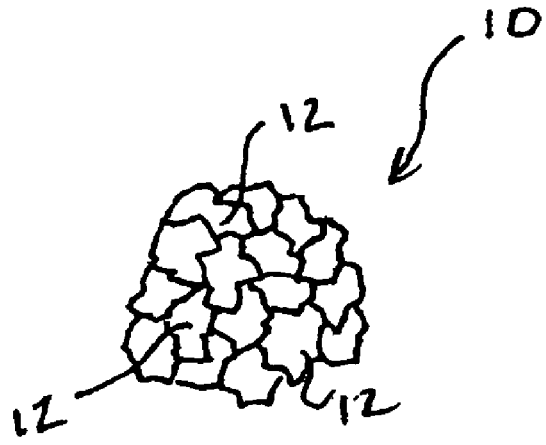
FIG. 1A is a schematic view of a thermally stable diamond bonded region of a polycrystalline diamond composite of this invention.

FIG. 1A schematically illustrates a section taken from a thermally stable diamond bonded region 10 of the diamond body of this invention. The thermally stable diamond bonded region 10 is one having a material microstructure comprising a plurality of diamond crystals 12 that are bonded to one another. Unlike conventional thermally-stable PCD, that is formed from conventional PCD that is subsequently treated to remove the solvent metal catalyst material thereby leaving open interstitial spaces between the bonded diamond crystals, the thermally stable diamond bonded region 10 of the diamond body of this invention is formed without using a catalyst metal solvent. Thereby producing a diamond bonded region that is inherently thermally stable and that does not include the open interstitial spaces, voids or regions between the diamond bonded crystals, i.e., it is essentially pure carbon with no binder phase.

It is to be understood that the diamond crystals 12 shown in FIG. 1A are configured having generally irregular shapes for purposes of illustration and reference. It is to be understood that the diamond crystals in the thermally stable diamond bonded can be configured having a variety of different shapes depending on such factors as the process and type of diamond that is used to form such region. For example, as described below and illustrated in FIG. 1B, the diamond crystals in this region can be configured having a columnar structure when the diamond is provided as material made by chemical vapor deposition (CVD diamond).

Methods useful for forming the thermally stable diamond bonded material can be any process that is known to create a volume of bonded diamond crystals that is essentially free of interstitial regions or any other second phase material. Methods known to provide such a desired volume of diamond bonded crystals, with a diamond volume density or content of essentially 100 percent, include chemical vapor deposition (CVD) and plasma vapor deposition (PVD). The CVD or PVD methods useful for producing the thermally stable diamond bonded region of the diamond body of this invention include those known in the art for otherwise producing layers or regions of exclusively bonded diamond crystals. Such methods generally involve a crystal growth process, whereby solid diamond bonded material is formed from a gas or plasma phase using a reactive gas mixture that supplies the necessary active species, i.e., carbon, onto a controlled surface. A desired characteristic of such diamond material provided by using CVD and/or PVD process is that it have a very high purity level and does not include any binder agent or other second phase that could otherwise adversely impact thermal stability of the bonded diamond crystals.

Figure 1B:
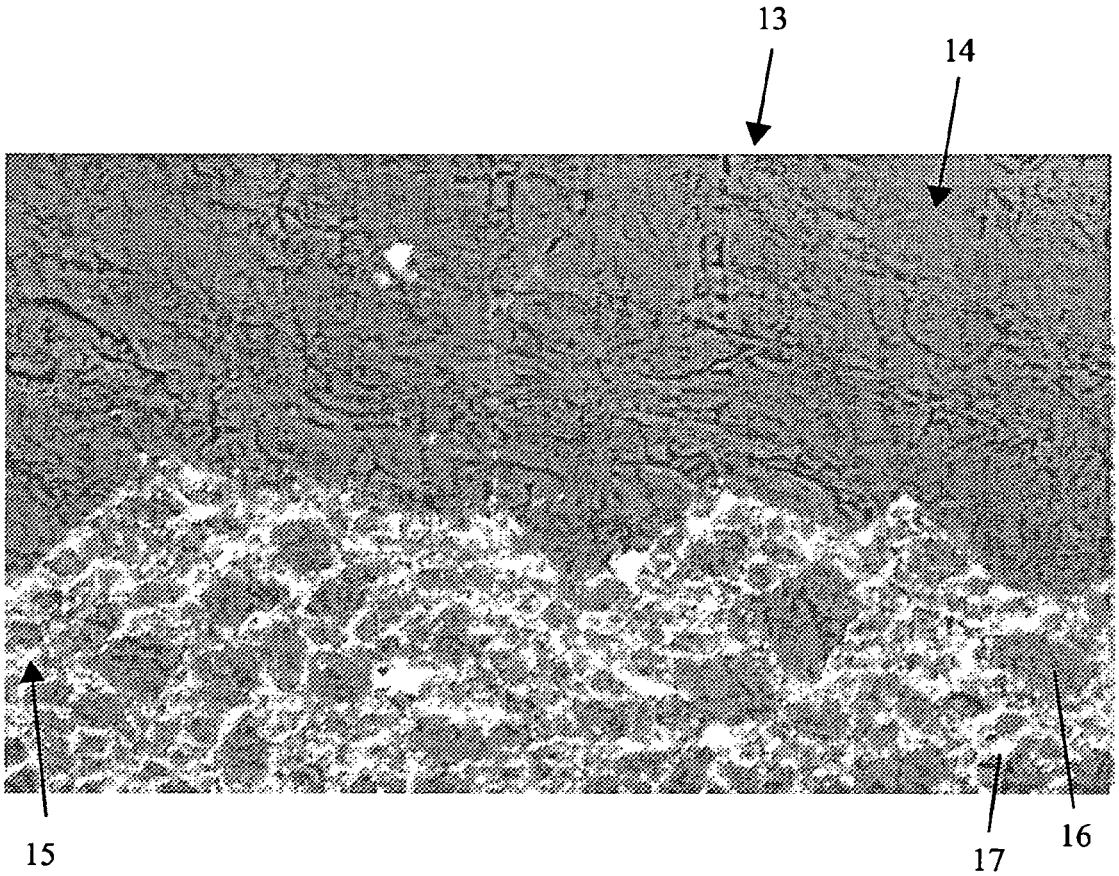
FIG. 1B is a back-scatter electron micrograph illustrating a region of the polycrystalline diamond composite of this invention comprising the thermally stable diamond bonded region joined to a polycrystalline diamond region.

FIG. 1B is a back-scatter electron micrograph illustrating a selected region of an example embodiment diamond bonded composite 13 of this invention comprising a diamond bonded region 14 that is joined to a polycrystalline diamond region 15. In this particular example, the diamond bonded region is formed by CVD that produces columnar diamond structure as illustrated. The polycrystalline diamond region 15 is shown to comprise a plurality of diamond crystals 16 (shown as the dark phases) with a metal solvent catalyst material 17 (shown as the white phases) disposed within interstitial regions between the diamond crystals.

In an example embodiment, the thermally stable diamond bonded material is formed using a CVD or PVD process to provide a material microstructure comprising a plurality of diamond bonded crystals having an average particle size in the range of from about 0.01 to 2,000 micrometers, and preferably in the range of from about 1 to 1,000 micrometers, and more preferably in the range of from about 5 to 300 micrometers. A thermally stable diamond bonded material comprising bonded together diamond crystals within the above particle size range provides desired properties of wear resistance and hardness that are especially well suited for such aggressive wear and/or cutting applications as for use with subterranean drill bits. However, it is to be understood that the particular particle size of the diamond crystals used to form the thermally stable diamond bonded material can and will vary depending on such factors as the thickness of the thermally stable diamond bonded material region, and the end use application.

Figure 2:
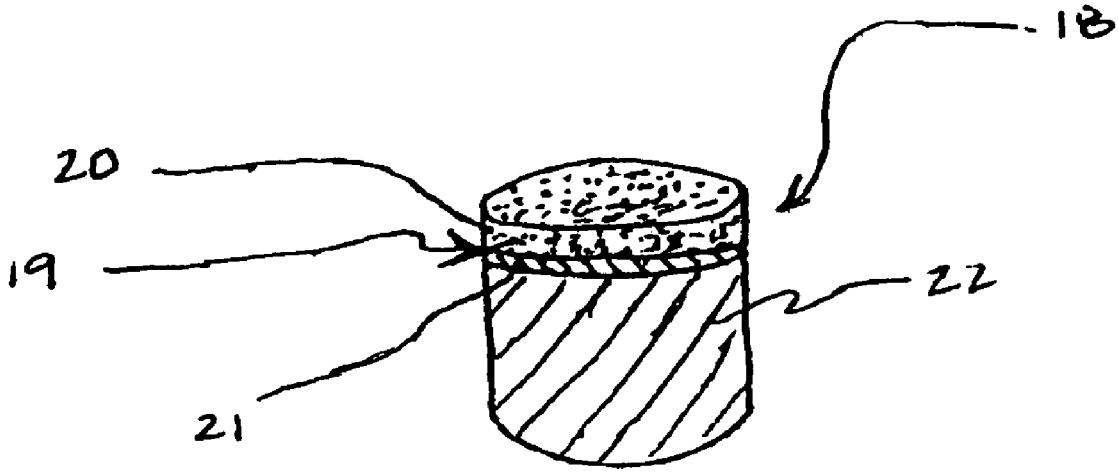
FIG. 2 is a perspective view of a polycrystalline diamond composite compact of this invention.

FIG. 2 illustrates a PCD composite material compact 18 constructed according to principles of this invention. Generally speaking, the compact 18 comprises a diamond bonded body 19 having the thermally stable diamond bonded region 20 as described above, a conventional PCD region 21, and a substrate 22, e.g., a metallic substrate, attached to the PCD region 20. While the PCD composite material compact 18 is illustrated as having a certain configuration, it is to be understood that PCD composite material compacts of this invention can be configured having a variety of different shapes and sizes depending on the particular wear and/or cutting application.

In an example embodiment, the compact 18 is formed by using two HPHT processes. In a first HPHT process, the conventional PCD region 21 is formed, i.e., it is consolidated and sintered, and is joined to the desired substrate 22. Diamond grains useful for forming the PCD region 21 include synthetic diamond powders having an average diameter grain size in the range of from submicrometer in size to 100 micrometers, and more preferably in the range of from about 5 to 80 micrometers. The diamond powder can contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attrittor milling for as much time as necessary to ensure good uniform distribution. The diamond powder may be combined with a desired solvent metal catalyst powder to facilitate diamond bonding during the HPHT process and/or the solvent metal catalyst can be provided by infiltration from the substrate. The diamond grain powder is preferably cleaned, to enhance the sinterability of the powder by treatment at high temperature, in a vacuum or reducing atmosphere.

Alternatively, the diamond powder mixture can be provided in the form of a green-state part or mixture comprising diamond powder that is contained by a binding agent, e.g., in the form of diamond tape or other formable/confirmable diamond mixture product to facilitate the manufacturing process. In the event that the diamond powder is provided in the form of such a green-state part it is desirable that a preheating step take place before HPHT consolidation and sintering to drive off the binder material. In an example embodiment, the PCD material resulting from the above-described HPHT process has a diamond volume content of approximately 95 percent, but other embodiments may fall in the range of from about 75 to about 99 volume percent.

The diamond powder mixture is loaded into a desired container for placement within a suitable HPHT consolidation and sintering device. In an example embodiment, where PCD composite material is provided in the form of a compact and the PCD region 21 is to be attached to a substrate, a suitable substrate material is disposed within the consolidation and sintering device adjacent the diamond powder mixture.

In a preferred embodiment, the substrate 22 is provided in a preformed state. Substrates useful for forming PCD composite compacts of this invention can be selected from the same general types of materials conventionally used to form substrates for conventional PCD materials, including carbides, nitrides, carbonitrides, ceramic materials, metallic materials, cermet materials, and mixtures thereof A feature of the substrate is that it include a metal solvent catalyst that is capable of melting and infiltrating into the adjacent volume of diamond powder to both facilitate conventional diamond-to-diamond intercrystalline bonding forming the PCD region, and to form a secure attachment between the PCD region and substrate. Suitable metal solvent catalyst materials include those metals selected from Group VIII elements of the Periodic table. A particularly preferred metal solvent catalyst is cobalt (Co), and a preferred substrate material is cemented tungsten carbide (WC—Co).

According to this method of making the compact, the container containing the diamond power and the substrate is loaded into the HPHT device and the device is then activated to subject the container to a desired HPHT condition to effect consolidation and sintering of the diamond powder. In an example embodiment, the device is controlled so that the container is subjected to a HPHT process having a pressure of approximately 5,500 Mpa and a temperature of from about 1,350° C. to 1,500° C. for a predetermined period of time. At this pressure and temperature, the solvent metal catalyst melts and infiltrates into the diamond powder mixture, thereby sintering the diamond grains to form conventional PCD, and forming a desired attachment or bond between the PCD region of the diamond bonded body and the substrate.

While a particular pressure and temperature range for this HPHT process has been provided, it is to be understood that such processing conditions can and will vary depending on such factors as the type and/or amount of metal solvent catalyst used in the substrate, as well as the type and/or amount of diamond powder used to form the PCD region. After the HPHT process is completed, the container is removed from the HPHT device, and the assembly comprising the bonded together PCD region and substrate is removed from the container.

The thermally stable diamond bonded material is then provided onto a designated surface of the PCD region of the assembly that will ultimately form the thermally stable surface of the diamond body and the PCD composite material compact. In an example embodiment, the thermally stable diamond bonded material is provided onto one or more surface of the PCD region that will ultimately define a wear and/or cutting surface of the diamond body and compact, to thereby provide improved properties of thermal stability at such surface.

The thermally stable diamond bonded material can be provided onto the surface of the PCD region by different methods. According to a first method, a desired thickness of thermally stable bonded diamond is grown separately from the PCD region as its own independent body or layer that is subsequently joined to the PCD region by a second HPHT process described below. This method of making the thermally stable diamond bonded material is useful for end use applications calling for a relatively thick thermally stable diamond bonded region, e.g., for applications calling for high levels of thermal stability, hardness and/or wear resistance. The thermally stable diamond bonded material body that is formed according to this method may have an average thickness of from about 10 microns to 3,000 microns, and preferably in the range of from about 100 microns to 1,000 microns. It is to be understood that this thickness is the thickness of the thermally stable diamond bonded material or body before it is joined to the PCD region by the second HPHT process.

Alternatively, the thermally stable diamond bonded material can be provided according to a second method that involves growing the bonded diamond onto the surface of the PCD region itself by the CVD or PVD process noted above. Prior to growing the layer, it may be necessary to treat the target surface of the PCD region in a manner that promotes growth of the thermally stable diamond bonded material thereon. This second method may be useful for end use applications calling for a relatively thin thermally stable diamond bonded region, e.g., for applications not calling for high levels of thermal stability, hardness and/or wear resistance. Accordingly, this second method of supplying the thermally stable diamond bonded material may be useful for providing such regions having an average thickness of from about 0.01 microns to 100 microns, and preferably in the range of from about 0.1 microns to 20 microns.

After the thermally stable diamond bonded material is formed, the assembly comprising the already joined together substrate and PCD region and the thermally stable diamond bonded material (whether provided in the form of an independent body or grown on the PCD region) is placed into an appropriate container and loaded into the HPHT device. The HPHT device is operated to impose a desired pressure and elevated temperature on the assembly to cause the thermally stable diamond bonded material to be joined to the PCD region, thereby completing formation of the diamond body and the PCD composite compact.

In an example embodiment, the second HPHT process is operated at a pressure and temperature condition that is sufficient to cause the solvent metal catalyst in the PCD region adjacent the thermally stable diamond bonded material to melt and to cause the diamond crystals along the interface between the PCD region and the thermally stable diamond bonded material to bond together. Additionally, during this HPHT process the thermally stable diamond bonded material is consolidated to form the thermally stable diamond bonded region of the diamond body. The HPHT process conditions can be the same as that disclosed above for the first HPHT process or can be different, e.g., can be operated at a higher temperature and/or pressure to impose a desired change on the physical properties of the diamond in one or both of the regions.

While this is one way of making the PCD composite compacts of this invention, there are other methods that are understood to be within the scope and practice of this invention. For example, rather than starting with a mixture of diamond powder and a substrate and subjecting the same to a first HPHT process to form a sintered substrate and PCD region assembly for subsequent combination with the thermally stable diamond bonded material, one can start with a sintered PCD body. In such case, the thermally stable diamond bonded material can be combined with the sintered PCD body according to either of the methods described above, and the combination of the substrate, the sintered PCD body and the thermally stable diamond bonded material can be placed in an appropriate container and loaded into the HPHT device.

The device can be operated at the same conditions noted above for the first or second HPHT process for the purpose of consolidating the thermally stable diamond bonded material, sintering it to the PCD region, and joining the PCD region to the substrate. This method could be useful in situations where the PCD material is available in sintered form, and would thus enable formation of the PCD composite compact of this invention by a single HPHT process.

Alternatively, rather than being provided after formation of the PCD region, the thermally stable diamond bonded material can be provided during an earlier stage of production that would enable formation of the PCD composite compact via a single HPHT process. In such alternative method of making, thermally stable diamond bonded material can be formed as an independent body in the manner described above, and can be combined with the diamond powder used to form the PCD region. Specifically, the thermally stable diamond bonded material body would be positioned within the container adjacent a designated surface of the diamond powder to form the thermally stable diamond bonded region in the sintered diamond body.

The substrate would also be positioned adjacent another surface of the diamond powder, and the container would be loaded into the HPHT device and subjected to the same pressure and temperature conditions noted above for the first HPHT process to form the PCD region, consolidate the thermally stable diamond bonded material, sinter the PCD region to the thermally stable diamond bonded material, and bond the PCD region to the substrate, thereby forming the PCD composite compact during a single HPHT process.

Figure 3:
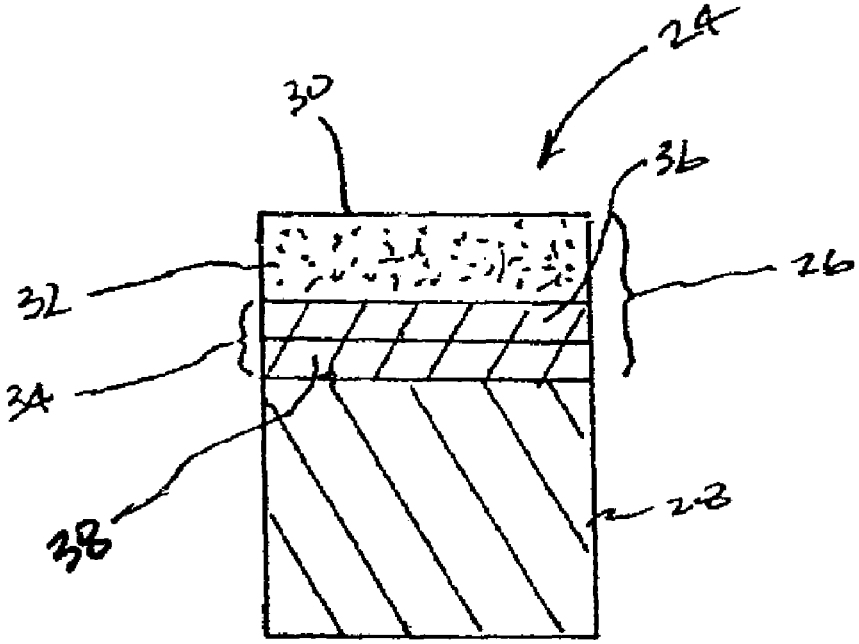
FIG. 3 is a cross-sectional schematic view of an embodiment of the polycrystalline diamond composite compact of this invention.

FIG. 3 illustrates another embodiment PCD composite compact 24 constructed according to principles of the invention. The PCD composite compact of this embodiment comprises a diamond body 26 attached to a substrate 28, wherein the diamond body has a working surface 30 positioned along an outermost top portion of the body that is formed from the thermally stable diamond bonded region 32. The diamond body includes the PCD region 34 that is interposed between the thermally stable diamond bonded region and the substrate. In this particular embodiment, the PCD region 34 comprises two different PCD material layers 36 and 38.

The PCD layers 36 and 38 each comprise PCD materials that have one or more property that is different from one another. For example, the PCD materials in these layers may be formed from differently sized diamond grains and/or have a different diamond volume content or density. For example, the diamond volume content in the PCD material layer 38 adjacent the substrate may be less than that of the diamond volume content in the PCD material layer 36.

The different PCD material layers can be formed in the manner described above by assembling different volumes of the different diamond powders into the container for HPHT processing, or by using different green-state parts having the above noted different properties. While FIG. 3 illustrates an embodiment of the PCD composite compact comprising a PCD region 34 made from two different PCD material layers 36 and 38, it is to be understood that this example embodiment is provided for purposes of reference and that PCD composite compacts of this invention can comprise a diamond body comprising a PCD region comprising any number of PCD material layers.

Alternatively, instead of comprising complete layers, the thermally stable diamond bonded region and/or the PCD region can be configured such that one or both occupy a portion of the volume of the diamond body. For example, the PCD region can be configured to occupy the bulk of the diamond body or table and the thermally stable diamond bonded region can be configured to occupy a small or partial volume positioned at or adjacent a working surface of the diamond body, which working surface can be positioned anywhere along an outside surface of the diamond body, e.g., along a top or side surface.

Alternatively, instead of comprising multiple discrete layers, the PCD region can be configured such that desired different properties in the PCD region is provided in the form of a continuum rather than as a step change. For example, the PCD region can be configured having a diamond volume content that changes as a function of distance moving away from the substrate. Accordingly, it is to be understood that such variations in the PCD region of such example embodiment PCD composite compacts are to be within the scope of this invention.

PCD composite compacts formed in accordance with the principles of this invention may have a PCD region thickness and substrate thickness that can and will vary depending on the particular end use application. In an example embodiment, for example when the PCD composite compact of this invention is provided in the form of a cutting element such as a shear cutter for use with a subterranean drill bit, the PCD composite compact may comprise a PCD region having a thickness of at least about 50 micrometers. In an example embodiment, the thickness of the PCD region can be in the range of from about 100 micrometers to 5,000 micrometers, preferably in the range of from about 1,000 micrometers to 3,000 micrometers.

The PCD composite compact may have a substrate thickness in the range of from about 2,000 micrometers to 20,000 micrometers, preferably in the range of from about 3,000 micrometers to 16,000 micrometers, and more preferably in the range of from about 5,000 micrometers to 13,000 micrometers. Again, it is to be understood that the exact thickness of the PCD region and substrate will vary on the end use application as well as the overall size of the PCD composite compact.

The above-described PCD composite materials and compacts formed therefrom will be better understood with reference to the following example:

EXAMPLE

PCD Composite Compact

Synthetic diamond powders having an average grain size of approximately 2-50 micrometers were mixed together for a period of approximately 2 to 6 hours by ball milling. The resulting mixture was cleaned by heating to a temperature in excess of about 850° C. under vacuum. The mixture was loaded into a refractory metal container and a preformed WC—Co substrate was positioned adjacent the diamond powder volume. The container was surrounded by pressed salt (NaCl) and this arrangement was placed within a graphite heating element. This graphite heating element containing the pressed salt and the diamond powder and substrate encapsulated in the refractory container was then loaded in a vessel made of a high-temperature/high-pressure self-sealing powdered ceramic material formed by cold pressing into a suitable shape.

The self-sealing powdered ceramic vessel was placed in a hydraulic press having one or more rams that press anvils into a central cavity. A first HPHT process was provided by operating the press to impose a processing pressure and temperature condition of approximately 5,500 MPa and approximately 1,300 to 1,500° C. on the vessel for a period of approximately 20 minutes. During this first HPHT process, cobalt from the WC—Co substrate infiltrated into an adjacent region of the diamond powder mixture and facilitated intercrystalline diamond bonding to form conventional PCD, thereby forming the PCD region of the PCD composite diamond body, and also joining the PCD region to the substrate.

The vessel was opened and the resulting assembly of the PCD region and the substrate was removed. The so-formed PCD region had a diamond volume content density of approximately 85 percent.

A thermally stable diamond bonded material was provided in the form of a preformed CVD body having a thickness of approximately 300 microns, and having an average particle size of about 100 microns. It is to be understood that the average particle size of diamond formed by CVD can and will vary through the layer thickness, generally increasing along the growth direction. Such crystals are typically in the form of elongated needles having large aspect ratios. The CVD body was positioned adjacent a surface of the PCD region and the combination of the CVD body and the assembly of the PCD region and substrate was loaded into a refractory metal container that was again surrounded by pressed salt and placed within a graphite heating element. The graphite heating element containing the pressed salt and the container was then loaded in a vessel made of a high-temperature/high-pressure self-sealing powdered ceramic material formed by cold pressing into a suitable shape.

The self-sealing powdered ceramic vessel was placed in a hydraulic press having one or more rams that press anvils into a central cavity. A second HPHT process was provided by operating the press was operated to impose a processing pressure and temperature condition of approximately 5,500 MPa and approximately 1,500° C. on the vessel for a period of approximately 20 minutes. During this second HPHT processing step, cobalt from the PCD region melts and infiltrates to the surface of the CVD body and facilitates sintering and diamond bonding between the diamond crystals at the interface of the PCD region and the CVD body to form integrally join the two diamond bonded regions together, thereby forming the resulting diamond bonded body. Additionally, during this second HPHT process, the CVD body is consolidated to form the thermally stable diamond bonded region.

The vessel was opened and the resulting assembly PCD composition compact of this invention comprising the substrate integrally joined to the diamond body, comprising the PCD region and the thermally stable diamond bonded region, was removed therefrom. Examination of the PCD compact revealed that the thermally stable diamond bonded region was well bonded to the PCD region. The so-formed PCD compact had a substrate thickness of approximately 11,000 microns, a PCD region thickness of approximately 2,000 microns, and a thermally stable diamond bonded region thickness of approximately 300 microns, and was provided in the form of a cutting element to be used with a fixed cone subterranean drill bit.

A feature of PCD composite materials and compacts of this invention is that they comprise a diamond bonded body having both a thermally stable diamond bonded region, positioned along a working wear and/or cutting surface, and a conventional PCD region. In a preferred embodiment, the thermally stable diamond bonded region is characterized by having essentially no interstitial regions, voids or spaces, and that comprises a diamond volume density of essentially 100 percent. The presence of these different diamond bonded regions provides a composite diamond bonded body having improved properties of thermal stability, wear resistance and hardness where it is needed most, i.e., at the working surface, while also comprising a PCD region interposed between the thermally stable diamond bonded region and the substrate to both facilitate attachment of the thermally stable diamond bonded region thereto, when the thermally stable diamond bonded region is provided as CVD or PVD diamond, and to facilitate attachment of the diamond body to the substrate.

Another feature of PCD composite compacts of this invention is the fact that they include a substrate, thereby enabling compacts of this invention to be attached by conventional methods such as brazing or welding to variety of different cutting and wear devices to greatly expand the types of potential use applications for compacts of this invention.

PCD composite materials and compacts of this invention can be used in a number of different applications, such as tools for mining, cutting, machining and construction applications, where the combined properties of thermal stability, wear and abrasion resistance are highly desired. PCD composite materials and compacts of this invention are particularly well suited for forming working, wear and/or cutting components or elements in machine tools and drill and mining bits, such as fixed and roller cone rock bits used for subterranean drilling applications.

Figure 4:
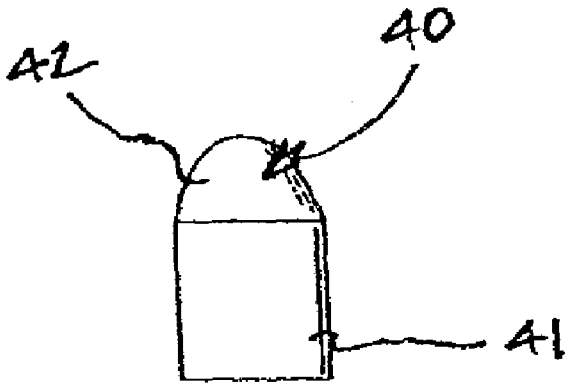
FIG. 4 is a perspective side view of an insert, for use in a roller cone or a hammer drill bit, comprising the polycrystalline composite compact of this invention.

FIG. 4 illustrates an embodiment of a PCD composite compact of this invention provided in the form of an insert 40 used in a wear or cutting application in a roller cone drill bit or percussion or hammer drill bit used for subterranean drilling. For example, such inserts 40 can be formed from blanks comprising a substrate portion 41 formed from one or more of the substrate materials disclosed above, and a diamond bonded body 42 having a working surface formed from the thermally stable diamond bonded region of the diamond bonded body. The blanks are pressed or machined to the desired shape of a roller cone rock bit insert.

Figure 5:
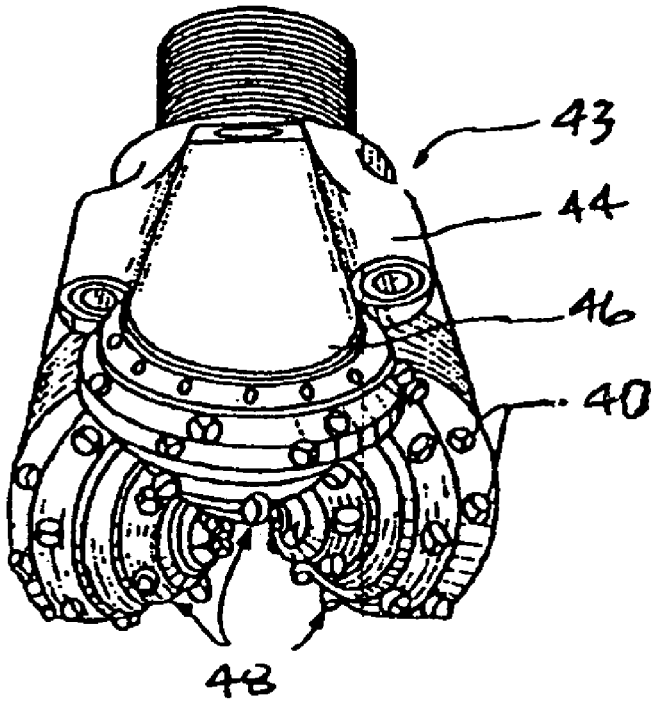
FIG. 5 is a perspective side view of a roller cone drill bit comprising a number of the inserts of FIG. 4.

FIG. 5 illustrates a rotary or roller cone drill bit in the form of a rock bit 43 comprising a number of the wear or cutting inserts 40 disclosed above and illustrated in FIG. 4. The rock bit 43 comprises a body 44 having three legs 46, and a roller cutter cone 48 mounted on a lower end of each leg. The inserts 40 can be fabricated according to the method described above. The inserts 40 are provided in the surfaces of each cutter cone 48 for bearing on a rock formation being drilled.

Figure 6:
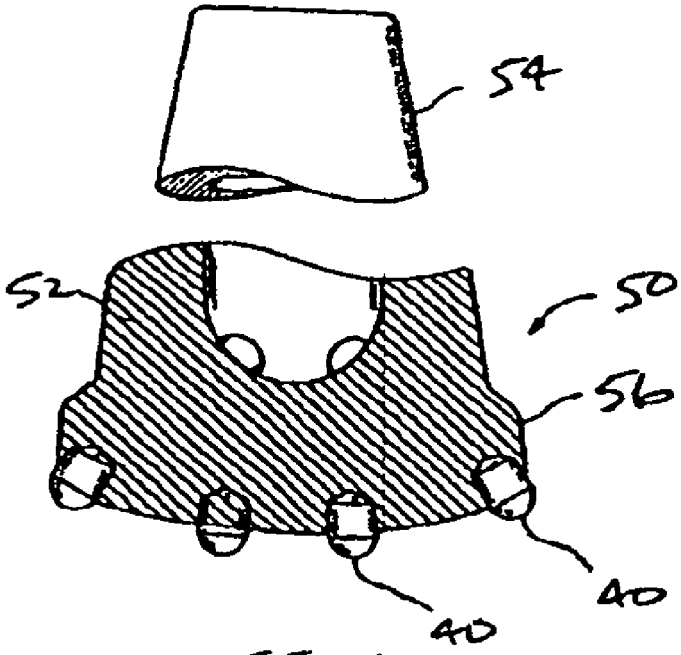
FIG. 6 is a perspective side view of a percussion or hammer bit comprising a number of inserts of FIG. 4.

FIG. 6 illustrates the inserts 40 described above as used with a percussion or hammer bit 50. The hammer bit comprises a hollow steel body 52 having a threaded pin 54 on an end of the body for assembling the bit onto a drill string (not shown) for drilling oil wells and the like. A plurality of the inserts 40 are provided in the surface of a head 56 of the body 52 for bearing on the subterranean formation being drilled.

Figure 7:
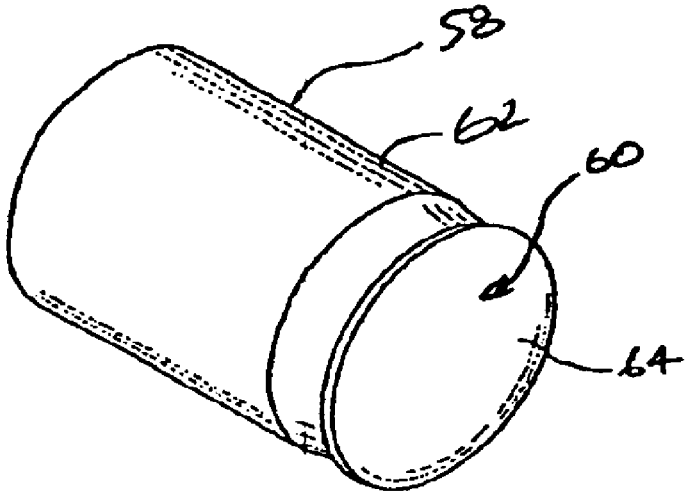
FIG. 7 is a schematic perspective side view of a diamond shear cutter comprising the thermally stable diamond bonded compact of FIGS. 2 and 3.

FIG. 7 illustrates a PCD composite compact of this invention embodied in the form of a shear cutter 58 used, for example, with a drag bit for drilling subterranean formations. The shear cutter 58 comprises a diamond bonded body 60, comprising both a PCD region and a thermally stable diamond bonded region, sintered or otherwise attached to a cutter substrate 62. The diamond bonded body includes a working or cutting surface 64 that is formed from the thermally stable region of the diamond bonded body.

Figure 8:
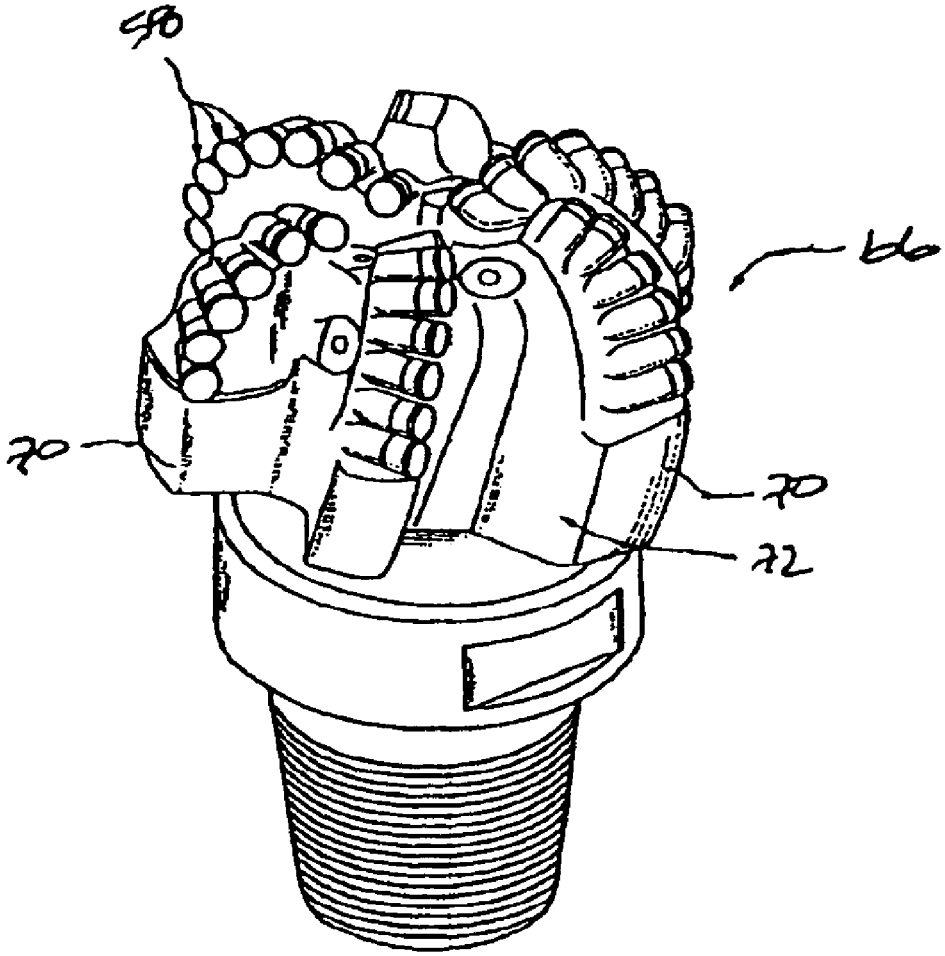
FIG. 8 is a perspective side view of a drag bit comprising a number of the shear cutters of FIG. 7.

FIG. 8 illustrates a drag bit 66 comprising a plurality of the shear cutters 58 described above and illustrated in FIG. 7. The shear cutters are each attached to blades 70 that each extend from a head 72 of the drag bit for cutting against the subterranean formation being drilled.

Other modifications and variations of PCD composite materials and compacts formed therefrom according to the principles of this invention will be apparent to those skilled in the art. It is, therefore, to be understood that within the scope of the appended claims, this invention may be practiced otherwise than as specifically described.

What is claimed is:

1. A PCD composite compact comprising:

a diamond bonded body comprising;

a thermally stable region extending a distance below a diamond bonded body surface, the thermally stable region having a material microstructure consisting of a single phase of bonded-together diamond crystals that is essentially free of any interstitial regions;

a polycrystalline diamond region extending a depth from the thermally stable region and bonded thereto, the polycrystalline diamond region comprising bonded together diamond crystals and interstitial regions interposed between the diamond crystals, wherein a metal solvent catalyst material is disposed within the interstitial regions; and a substrate attached to the diamond bonded body.

2. The PCD composite compact as recited in claim 1 wherein the thermally stable region has a diamond volume density of approximately 100 percent.

3. The PCD composite compact as recited in claim 1 wherein the thermally stable region extends a depth of less than about 0.1 mm from the working surface.

4. The PCD composite compact as recited in claim 1 wherein the thermally stable region extends a depth of greater than about 0.1 mm from the working surface.

5. The PCD composite compact as recited in claim 1 wherein the polycrystalline diamond region has a thickness of at least about 50 micrometers.

6. The PCD composite compact as recited in claim 1 wherein the polycrystalline diamond region has a thickness in the range of from about 100 to 5,000 micrometers.

7. The PCD composite compact as recited in claim 1 wherein the substrate is integrally joined to the polycrystalline diamond region of the diamond body.

8. The PCD composite compact as recited in claim 1 wherein the polycrystalline diamond region comprises a volume content of diamond crystals that changes with location within the polycrystalline diamond region.

9. A drill bit used for drilling subterranean formations comprising a body and a number of cuffing elements attached to the body, the cuffing elements being formed from the PCD composite compact as recited in claim 1.

10. A diamond bonded composite construction comprising:

a diamond bonded body including:

a polycrystalline diamond region comprising a plurality of bonded together diamond crystals and interstitial regions interposed between the diamond crystals, wherein the polycrystalline diamond region has a diamond volume content of less than about 99 percent;

a thermally stable diamond bonded region comprising a diamond volume content of approximately 100 percent and being essentially free of interstitial regions, the thermally stable diamond bonded region being bonded to the polycrystalline diamond region; and a substrate bonded to the diamond body.

11. A PCD composite compact made by the process of:

combining:

a first volume of diamond crystal-containing material comprising bonded together diamond crystals and interstitial regions interposed between the diamond crystals, wherein a metal solvent catalyst material is disposed within the interstitial regions; with a second volume of diamond crystal-containing material consisting of a single phase of bonded together diamond crystals that is substantially free of interstitial regions;

wherein the first volume of diamond crystal-containing material is in contact with a substrate, and wherein the first volume of diamond-containing material, the second volume of diamond-containing material, and the substrate comprise an assembly; and subjecting the assembly to high pressure/high temperature conditions to form a diamond bonded body that is attached to the substrate and that comprises a polycrystalline diamond region formed from the first diamond crystal-containing material, and a thermally stable diamond bonded region that is formed from the second diamond-containing material, wherein the polycrystalline diamond region and the thermally stable diamond bonded region are integrally joined together, and wherein the thermally stable diamond bonded region is positioned along a working surface of the compact.

12. The PCD composite compact as recited in claim 11 wherein the second volume of diamond crystal-containing material is formed by processes selected from the group consisting of chemical vapor deposition and plasma vapor deposition.

13. The PCD composite compact as recited in claim 11 wherein the second volume of diamond crystal-containing material has a diamond volume content of 100 percent.

14. The PCD composite compact as recited in claim 11 wherein the thermally stable diamond bonded region of the diamond bonded body extends a depth from the working surface of less than about 0.1 mm.

15. The PCD composite compact as recited in claim 11 wherein the thermally stable diamond bonded region of the diamond bonded body extends a depth from the working surface of greater than about 0.1 mm.

16. The PCD composite compact as recited in claim 11 wherein the polycrystalline diamond region has a thickness of greater than about 50 microns.

17. The PCD composite compact as recited in claim 11 wherein the polycrystalline diamond region has a thickness in the range of from about 100 microns to 5,000 microns.

18. A PCD composite compact made by the process of:

combining:

a volume of diamond powder; with a substrate, wherein at least one of the diamond powder and the substrate includes a solvent metal catalyst;

subjecting the volume of diamond powder and the substrate to a first high pressure/high temperature condition to consolidate and sinter the diamond powder to form a polycrystalline diamond region, and to join the polycrystalline diamond region to the substrate to form an assembly;

combining the assembly with a volume of thermally stable diamond bonded material consisting essentially of bonded together diamond crystals, wherein the volume of thermally stable diamond bonded material is positioned adjacent the polycrystalline diamond region; and subjecting the assembly and the volume of thermally stable diamond bonded material to a second high pressure/high temperature condition to consolidate the volume of thermally stable diamond bonded material to form a thermally stable diamond bonded region, and bond the thermally stable diamond bonded region to the polycrystalline diamond region to form a diamond bonded body, wherein the diamond bonded body comprises the polycrystalline diamond region interposed between the substrate and the thermally stable diamond bonded region, and wherein the thermally stable diamond bonded region has a diamond volume content of approximately 100 percent and is essentially free of interstitial regions.

19. The PCD composite compact as recited in claim 18 wherein the volume of diamond powder comprises diamond grains having an average particle size in the range of from about 0.1 micrometers to 200 micrometers.

20. The PCD composite compact as recited in claim 18 wherein the volume of thermally stable diamond bonded material is formed by processes selected from the group consisting of chemical vapor deposition and plasma vapor deposition.

21. The PCD composite compact as recited in claim 18 wherein the thermally stable diamond bonded region extends a depth from a working surface of the diamond body of less than about 0.1 mm.

22. The PCD composite compact as recited in claim 18 wherein the thermally stable diamond bonded region extends a depth from a working surface of the diamond body of greater than about 0.1 mm.

23. The PCD composite compact as recited in claim 18 wherein the polycrystalline diamond region has a thickness of greater than about 50 microns.

24. The PCD composite compact as recited in claim 18 wherein the polycrystalline diamond region has a thickness in the range of from about 100 microns to 5,000 microns.

* * * * *